US007125049B2

(12) United States Patent
Goldberg et al.

(10) Patent No.: US 7,125,049 B2
(45) Date of Patent: Oct. 24, 2006

(54) BOOKMARKS

(75) Inventors: Seth Goldberg, Oceanside, NY (US); Bennell Kaye, Oceanside, NY (US)

(73) Assignee: Grand Band, Inc., Oceanside, NY (US)

( * ) Notice: Subject to any disclaimer, the term of this patent is extended or adjusted under 35 U.S.C. 154(b) by 76 days.

(21) Appl. No.: 10/812,398

(22) Filed: Mar. 30, 2004

(65) Prior Publication Data

US 2005/0225074 A1 Oct. 13, 2005

(51) Int. Cl.
*B42D 9/00* (2006.01)

(52) U.S. Cl. ..... 281/42; 116/234; 116/235; 116/236; 116/237; 116/238; 116/239; 116/240; 116/243; 11/46; 11/78.1; 11/86; 11/200; 11/201; 11/202; 11/203; 11/212; 19/34; 24/3.13; 24/3.2

(58) Field of Classification Search ..... 281/42; 116/234–240, 243; D19/34; D11/78.1, 200, D11/203, 46, 86, 201, 202, 212; 24/3.13, 24/3.2

See application file for complete search history.

(56) References Cited

U.S. PATENT DOCUMENTS

| | | | | |
|---|---|---|---|---|
| 132,230 | A | 10/1872 | Arms | |
| 151,036 | A | 5/1874 | Liebenroth | |
| 152,876 | A | 7/1874 | Smith | |
| 212,578 | A | 2/1879 | Smith | |
| 956,534 | A | 5/1910 | Lahey | |
| 1,245,455 | A | 11/1917 | Gilchrist | |
| 1,960,690 | A | 5/1934 | Blair | |
| 2,716,459 | A * | 8/1955 | Toney et al. | 416/22 |
| 3,073,439 | A | 1/1963 | Symmonds | |
| 3,712,712 | A * | 1/1973 | Bosma | 359/813 |
| 4,041,892 | A * | 8/1977 | Nichols | 116/239 |
| 4,901,665 | A * | 2/1990 | Carlin | 116/235 |
| 5,052,602 | A | 10/1991 | Duchi, Jr. et al. | |
| 5,054,816 | A | 10/1991 | Rosengarten | |
| 5,077,869 | A | 1/1992 | Haase | |
| 5,081,948 | A * | 1/1992 | Walsh | 116/235 |
| 5,279,019 | A | 1/1994 | Knickle | |
| D346,399 | S * | 4/1994 | Schad et al. | D19/34 |
| 5,305,706 | A * | 4/1994 | Arjomand | 116/234 |
| 5,367,752 | A | 11/1994 | Petty | |
| 5,408,950 | A * | 4/1995 | Porto | 116/239 |
| D374,459 | S * | 10/1996 | Vartanian | D19/34 |
| 5,577,459 | A * | 11/1996 | Alden | 116/234 |
| 5,586,707 | A * | 12/1996 | Haskell | 224/684 |
| 5,709,013 | A * | 1/1998 | Stanback | 24/66.9 |
| 5,718,023 | A * | 2/1998 | Billish | 24/11 HC |
| 5,816,072 | A * | 10/1998 | Michaels | 63/3 |
| 5,913,618 | A | 6/1999 | Yosha | |
| D424,108 | S * | 5/2000 | Mitcham | D19/34 |
| 6,205,622 | B1 | 3/2001 | Odishoo | |
| 6,230,878 | B1 | 5/2001 | Lehr | |

(Continued)

*Primary Examiner*—Monica Carter
*Assistant Examiner*—Mark Henderson
(74) *Attorney, Agent, or Firm*—Millen, White, Zelano & Branigan, P.C.

(57) ABSTRACT

A bookmark includes a seamless elastic band which is stretchable to loop around a group of pages in a book and around a cover of the book in order to identify a page place in the book. The band includes a slider thereon which has a front surface are that receives an image which is on one side of a sticker. When a bookmark is placed on a book, the slide is moveable along the elastic band while the elastic band is stationary, so that the slider can be placed at different locations on the cover of the book.

9 Claims, 4 Drawing Sheets

U.S. PATENT DOCUMENTS 6,357,084 B1 3/2002 Haidon
6,446,803 B1 * 9/2002 McKinney ..... 206/371
6,641,172 B1 * 11/2003 Olson ..... 281/42
6,880,364 B1 * 4/2005 Vidolin et al. ..... 63/40
7,004,106 B1 * 2/2006 Forance ..... 116/238
2002/0158462 A1 * 10/2002 Antoine ..... 281/42

* cited by examiner

BOOKMARKS

FIELD OF THE INVENTION

The present invention relates to bookmarks, and more particularly, the present invention relates to bookmarks with indicia thereon.

BACKGROUND OF THE INVENTION

Most modern books have relatively rigid covers and backs. This is true of even paperback books in which the covers are generally stiffer than the pages. Bookmarks in the form of elastic bands have evolved because the typical bookmark can slip out of a book while elastic bands remain in place. However, elastic band bookmarks have not achieved a wide degree of public acceptance even though they enable a reader to more securely mark a page of a book.

In view of the aforementioned considerations, there is a need for bookmarks employing endless elastic bands which achieve a greater degree of public acceptance.

SUMMARY OF THE INVENTION

The present invention is directed to a bookmark comprising a flat, seamless elastic band configured as a loop, the loop having a relaxed diameter less than the height of the book and being elastically expandable to a diameter greater than the height of the book so that the elastic band encompasses a front or back cover of the book and a selected number of pages when expanded with a portion of it's length disposed within the book. The band has a display element slidably disposed thereon which has an outwardly facing surface including display substrate. A selected display panel having a first side with an image thereon and a second side with adhesive thereon is the mounted on the display substrate.

In a further aspect of the invention, a pair of wings extend laterally from the display substrate, the wings having flanges that form a tube around the band to enclose the band.

In still a further aspect of the invention, the flanges each have side edges that are opposed in spaced relation to one another to define gaps therebetween, wherein the elastic band is insertable edgewise through the gaps to secure the elastic band to a slider.

In still a further aspect of the invention, the display substrate is circular and the selected display panel is circular.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
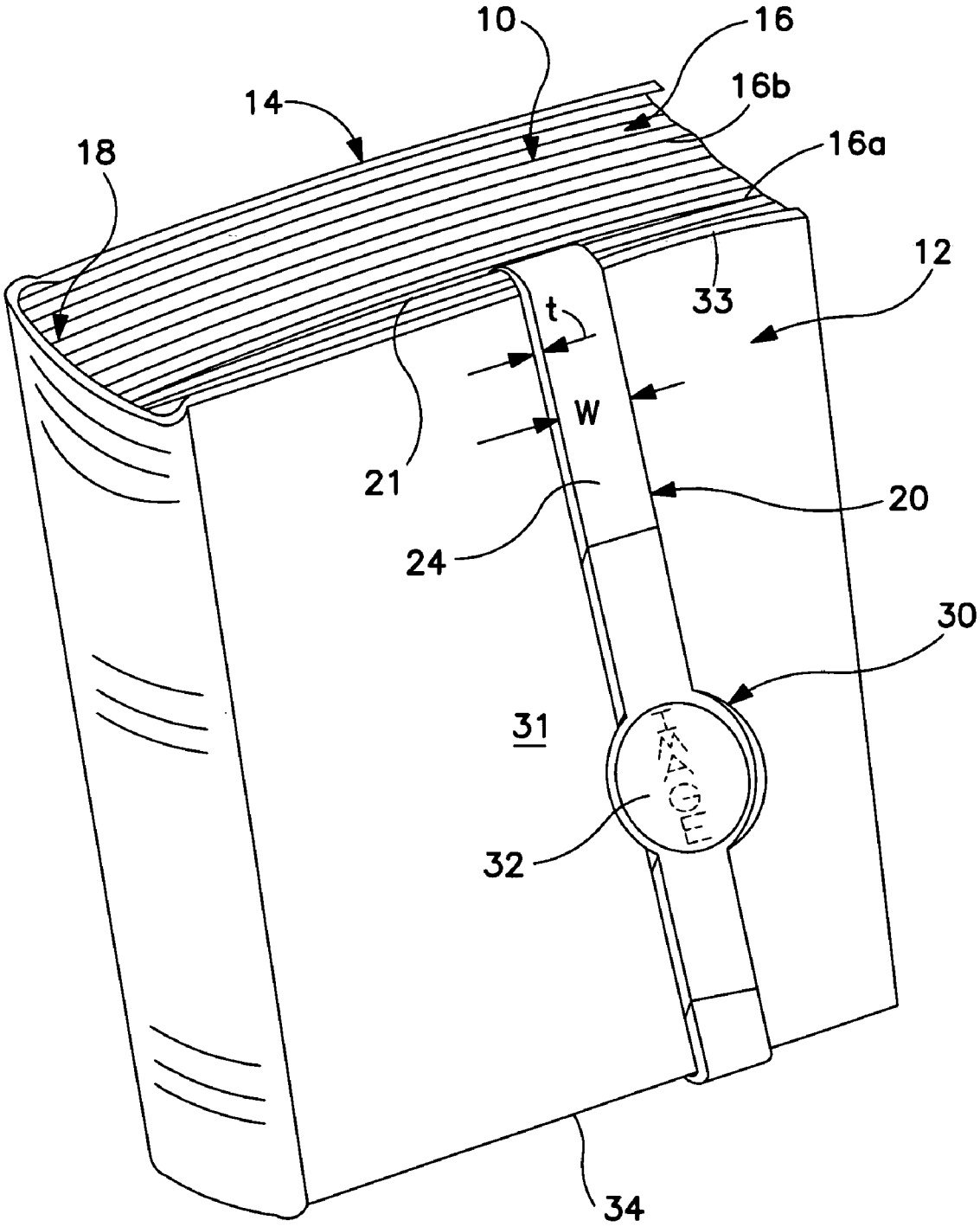
FIG. 1 is a perspective view of a bookmark, configured in accordance with the present invention, shown marking a page in a book.

Referring now to FIG. 1 there is shown a book 10 having a relatively stiff front cover 12 and a relatively stiff back cover 14 between which are disposed relatively flexible pages 16 that are attached to one another along a binding 18. A bookmark 20, configured in accordance with the principles of the present invention, is used to separate a first group of pages 16*a* from a second group of pages 16*b* in order to readily identify one or two pages of interest facing a gap 21 between the groups of pages.

Figure 2:
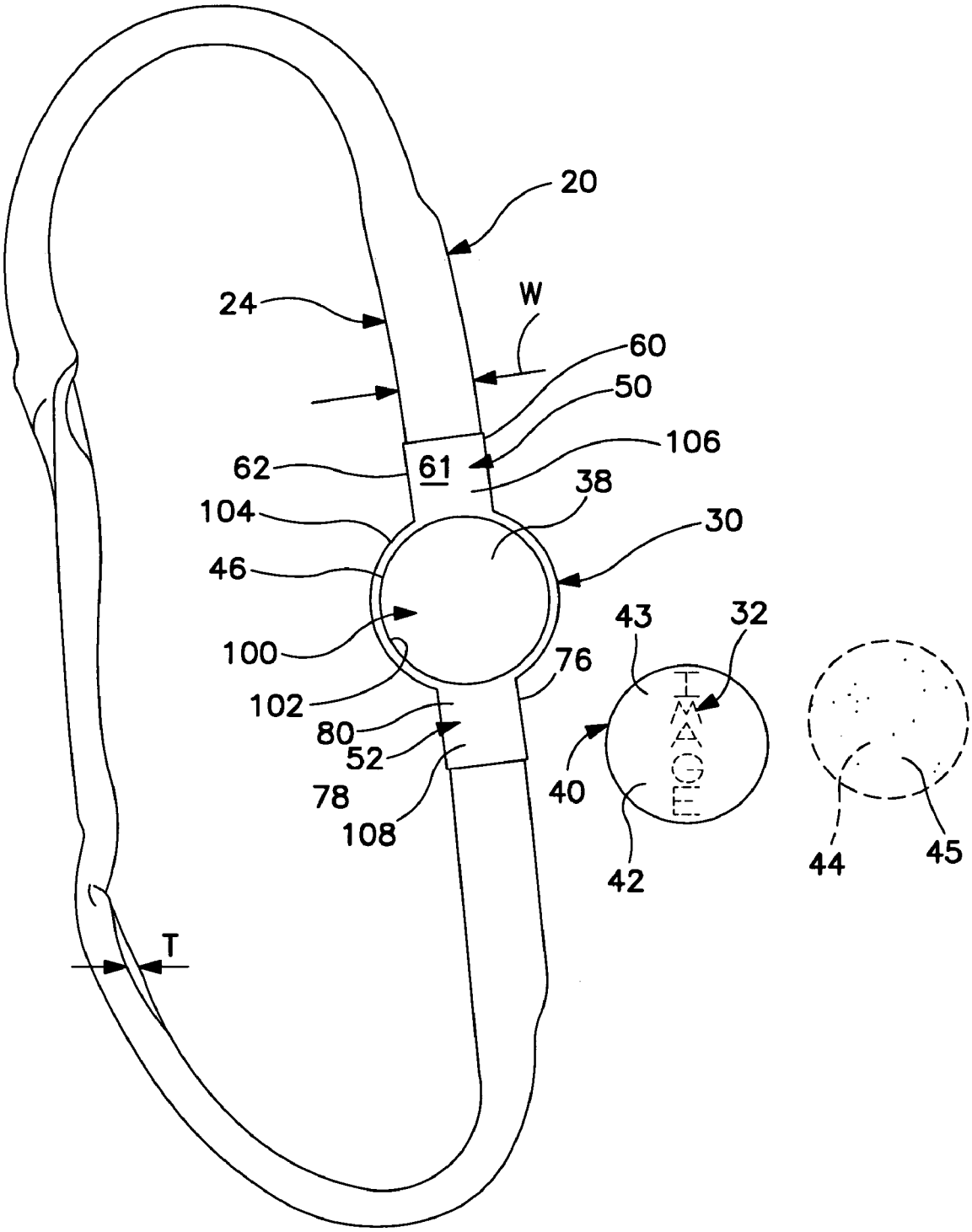
FIG. 2 is a perspective view of the bookmark used in FIG. 1, but detached from the book and showing an imaged sticker detached from the bookmark, the sticker having an imaged face and an adhesive face (shown in dotted lines)
Figure 3:
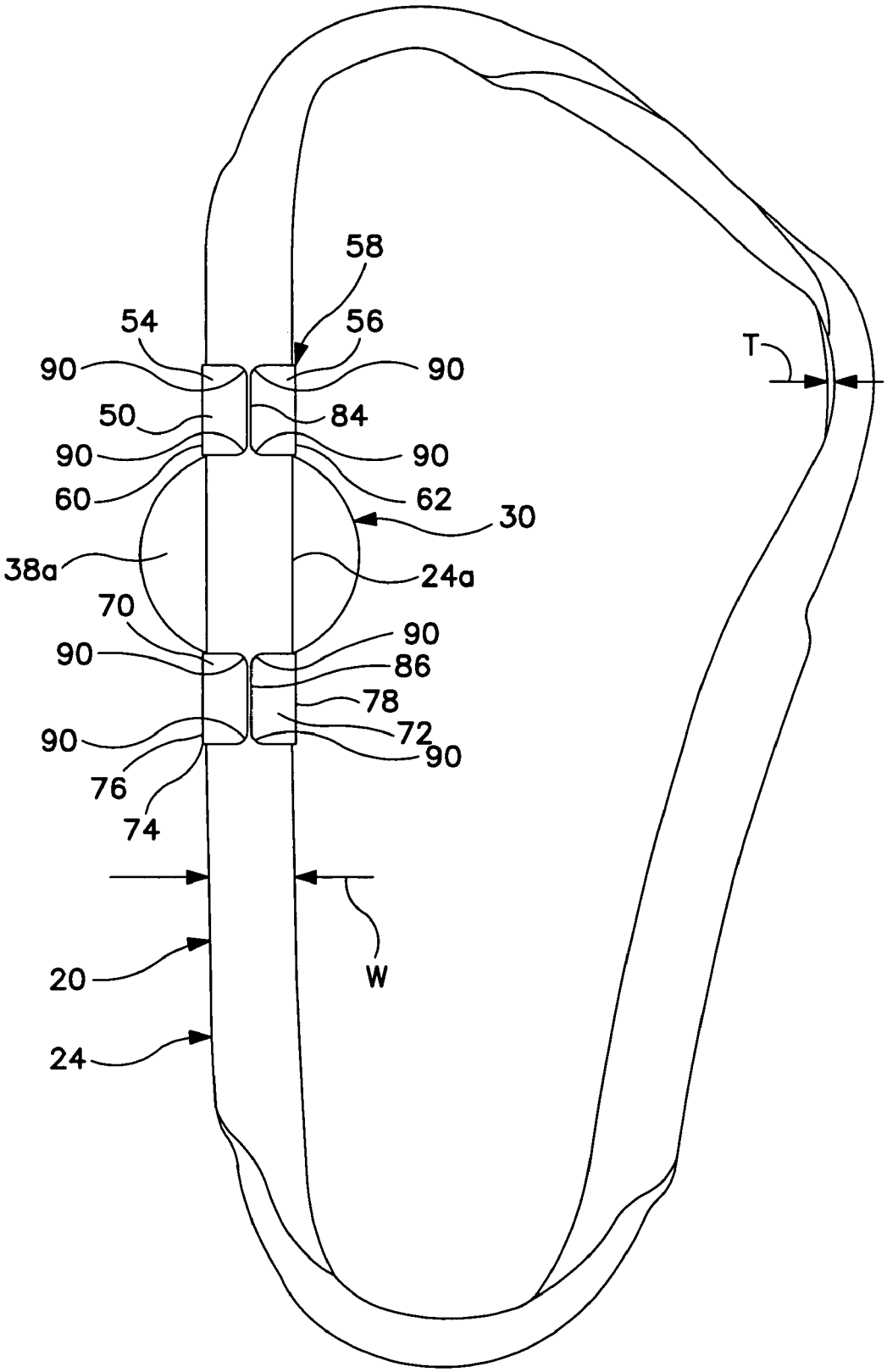
FIG. 3 is a view similar to FIG. 2 but showing the inside surface of the elastic band and a rear surface of the slider.

The bookmark 20 is comprised of an elastic band 24 which is both seamless and flat, having a width "W" substantially greater than it's thickness "T." The seamless elastic band 24 has a relaxed length shown in FIGS. 2 and 3 that is less than its expanded length shown in FIG. 1. In FIG. 1 the elastic band 24 is stretched to extend over the book cover 12 and through the gap 21 between the groups of pages 16*a* and 16*b*. The stretched elastic band 24 frictionally engages the cover 12 of the book, the top and bottom edges of the cover and the pages facing one another in the gap 21 so as to be securely mounted on the book 10. When the book 10 is opened, the bookmark 20 remains in place until affirmatively removed by the person handling the book and does not drop out, as is the case with conventional bookmarks.

As is seen in FIG. 1-3, a slider 30, preferably made of metal, is mounted on the elastic band 24. The slider 30 has indicia 32 thereon, which indicia can be any selective image and may include, for example, written information and/or a pictorial image. When the elastic band 24 is stretched as in FIG. 1, the slider 30 is readily slid along the elastic band. This is because when the elastic band 24 is stretched, its width W and thickness T are reduced. There are however sufficient frictional forces between the elastic band 24, slider 30 and surface 31 of the book cover 12 to keep the slider 30 positioned in a selected position on the book cover until the slider is pushed either toward the top edge 33 or bottom edge 34 of the cover.

As is seen in FIG. 2, the slider 30 has an image support area 38 on which the image 32 is placed. In accordance with a preferred embodiment of the present invention, the image 32 is in the form of a sticker 40 which has a front side 42 bearing the image 32. The image 32 is preferably covered with a transparent plastic layer 43 which preferably has the diameter of the front side 42 of the sticker 40. The sticker 40 has a rear side 44 which is coated with adhesive 45. The adhesive 45 on rear side 44 adheres to the surface of the image support area 38 of the slider 30. Preferably, the adhesive 45 is a permanent adhesive so that the sticker 40 is difficult to remove. Alternatively, the adhesive is placed on the image support area 38 of the slider 30. In order to center the sticker 40, there is a rim 46 surrounding the image support area 38, within which rim the sticker 40 is positioned. While it is preferable that the support area 38 is circular as illustrated in each of the figures, the support area 38 in other embodiments may have other shapes such as square, rectangular, oval or any shape compatible with the principles of this invention. The sticker 40 may also have shapes other than circular.

Figure 4:
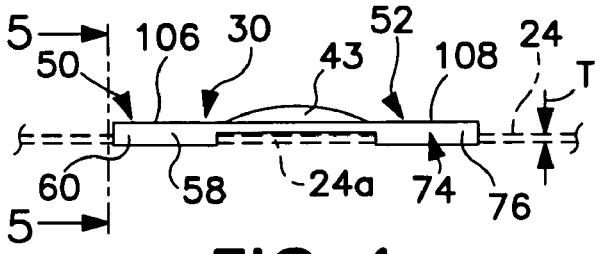
FIG. 4 is a side view of the slider and a portion of the elastic band shown in dotted lines.
Figure 5:
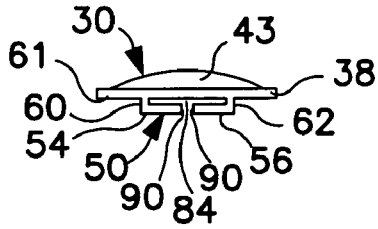
FIG. 5 is a view of the slider detached from the elastic band.

The slider 30 has first and second wings 50 and 52, respectively, which extend laterally from the image support area 38. As is seen in FIGS. 3–5, the wing 50 has a pair of flanges 54 and 56 which are folded over to form a tubular portion 58 with a rectangular cross section. The tubular portion 58 has a depth defined by side walls 60 and 62 of the wing 50 which extend transverse, and preferably normal to a front wall 61 (FIG. 2) of the wing 50.

The second wing 52 has a pair of flanges 70 and 72 which as seen in FIG. 3 are folded over to form a tube 74 with a rectangular cross section. The tube 74 has a width defined by side walls 76 and 78 which extend transverse and preferably normal to a front wall 80 (FIG. 2) of the wing 52.

As is seen in FIG. 3, the flanges 54 and 56 on the tube 58 are separated by a gap 84 and the flanges 70 and 72 of the tube 74 are separated by a gap 86. The gaps 84 and 86 are both slightly narrower than the thickness T of the elastic band 24, while the distance between the side walls 60 and 62 of the tube 58 and side walls 76 and 78 of the tube 74 are preferably slightly less than the width W of the elastic band 24. Consequently, until the elastic band 24 is stretched so as to decrease both it's width W and thickness T, the slider 30 is frictionally held relatively tightly in place on the elastic band. As has been previously discussed, when the elastic band 24 is stretched it becomes both narrower and thinner thus allowing the slider 30 to more readily slide along the elastic band 24. As is apparent in FIG. 3, the elastic band 24 has portion 24*a* which is disposed adjacent to the back surface 38*a* of the image display area 38. The portion 24*a* is frictionally engageable with the outer surface 31 of the book cover 12 (see FIG. 1).

In order to make it easier to insert the band 24 through the slots 84 and 86 in the tubes 58 and 74, the flanges 54 and 56 and the flanges 70 and 72 each have curved corners 90 so that the corners of the flanges do not bite into the surface of the elastic band 24 as the slider 30 is slid thereon. In addition, the curved corners 90 facilitate insertion of the elastic band 24 through the slots 84 and 86, again because the curved corners 90 do not bite into the elastic band.

Preferably, the image support area 38 has a circular indentation 100 therein defined by an inwardly facing ridge 102 extending to the rim 46. The rim 46 has a front surface 104 which is flush with front surfaces 106 and 108 of the wings 50 and 52, respectively.

Figure 6:
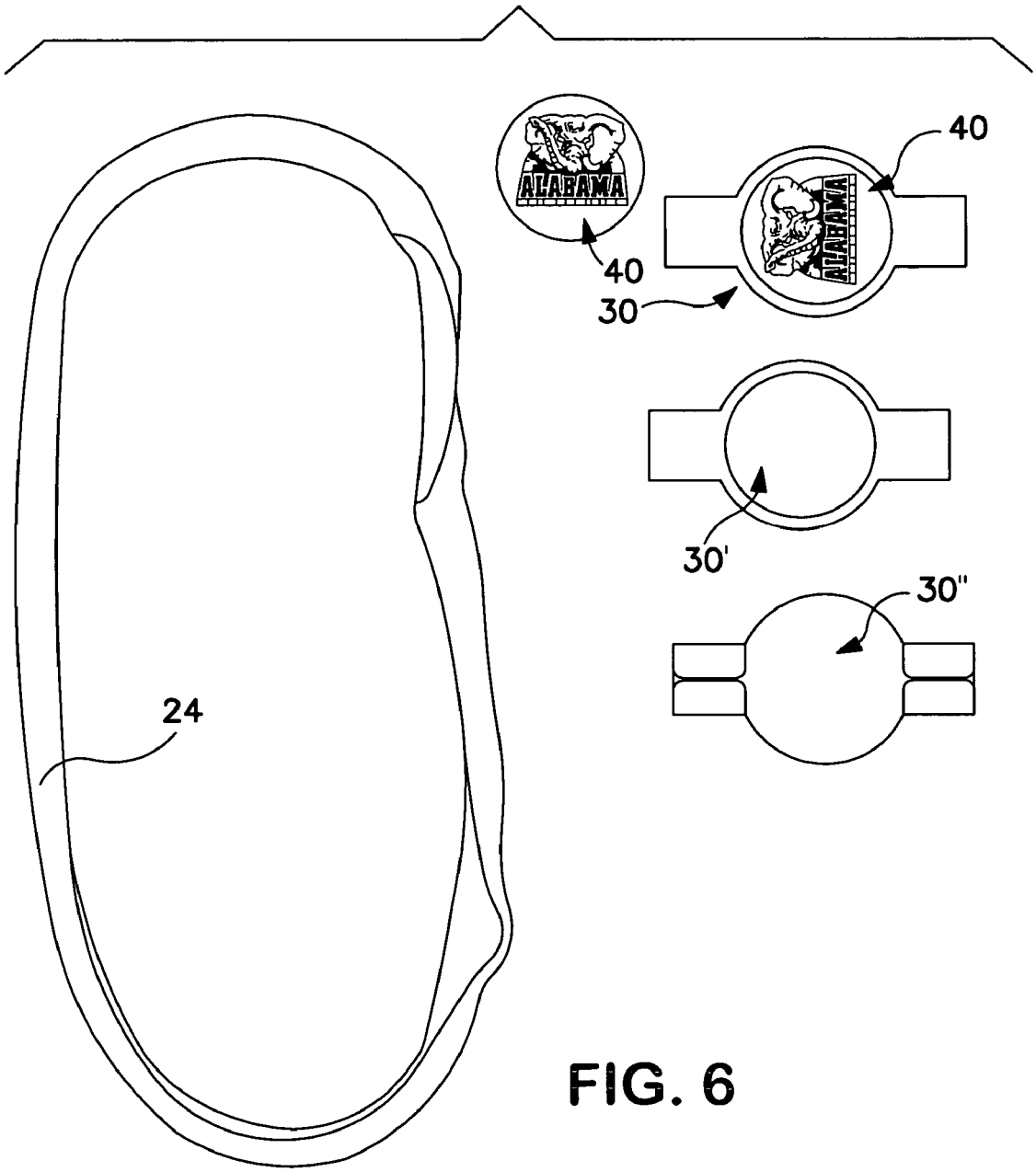
FIG. 6 is a view of a kit including components of the present invention.

Referring now to FIG. 6, there is shown a kit 120 comprising the elastic band 24, three sliders 30, 30' and 30" and a sticker 40. The slider 30' has no sticker attached, and the slider 30" is shown from the back. The sticker 40' is shown as a medallion separate from the slider. These components when assembled provide customized bookmarks 20 (FIG. 1) wherein the retail customer or the retailer can select many different images 32 and different elastic bands of different colors and designs. While only one elastic band 24, one separate sticker and three sliders 30, 30' and 30" are shown, the kit 120 preferably comprises numerous elastic bands, stickers and sliders.

From the foregoing description, one skilled in the art can easily ascertain the essential characteristics of this invention, and without departing form the spirit and scope thereof, can make various changes and modifications of the invention to adapt it to various usages and conditions.

We claim:

1. A bookmark comprising:

an elastic band having a selected width between two edges and a selected thickness, the elastic band being expandable from a relaxed condition to a stretched condition when placed over a page of a book and over an outside cover of the book;

a slider mounted on the elastic band, the slider having an outer surface facing away from the elastic band and an inner surface facing toward the elastic band, the outer surface having a rim portion;

an indented display surface on the outer surface of the slider defined by the rim portion, the indented display surface having a width greater than the width of the elastic band;

a sticker adhered to the indented display surface with the rim portion extending around the sticker, the sticker having an image on a front surface thereof and adhesive on a back surface thereof wherein the sticker is secured by the adhesive to the indented display surface;

first and second wings extending from the indented display surface, the first and second wings having flanges thereon which are folded to form first and second tubes for receiving the elastic band therethrough with the elastic band being exposed between the first and second tubes for direct contact with a cover of a book with which the bookmark is used, and first and second gaps in the first and second tubes, the gaps being between opposed edges of the flanges folded to form the first and second tubes, the gaps each having a width sufficiently large to receive at least one of the edges of the elastic band therethrough when the elastic band is stretched.

2. The bookmark of claim 1 wherein the display surface is circular and the sticker is circular.

3. The bookmark of claim 1 wherein the indented display surface is circular and the sticker is circular.

4. The bookmark of claim 1 wherein the tubes have internal edges and external edges, the internal edges being spaced from one another by the width of the indented display surface wherein the band is exposed as the band extends beneath the indented display surface.

5. The bookmark of claim 2 wherein the tubes have internal edges and external edges, the internal edges being spaced from one another by the diameter of the display surface wherein the band is exposed as the band extends beneath the display surface.

6. The bookmark of claim 5 wherein when the elastic band is in the relaxed condition it frictionally engages with the inner surfaces of the tubes and the edges of the tubes with a higher frictional force than occurs when the band is relaxed.

7. The bookmark of claim 3 wherein the tubes have internal edges and external edges, the internal edges being spaced from one another by the width of the indented display surface wherein the band is exposed as the band extends beneath the indented display surface.

8. The bookmark of claim 7 wherein when the elastic band is in the relaxed condition it frictionally engages with the inner surfaces of the tubes and the edges of the tubes with a higher frictional force than occurs when the band is relaxed.

9. The bookmark of claim 4 wherein the tubes have internal edges and external edges, the internal edges being spaced from one another by the width of the indented display surface wherein the band is exposed as the band extends beneath the indented display surface.

* * * * *

UNITED STATES PATENT AND TRADEMARK OFFICE

CERTIFICATE OF CORRECTION

PATENT NO. : 7,125,049 B2
APPLICATION NO. : 10/812398
DATED : October 24, 2006
INVENTOR(S) : Seth Goldberg It is certified that error appears in the above-identified patent and that said Letters Patent is hereby corrected as shown below:

Column 2, line 19 reads “substantially greater than it’s thickness “T.” The seamless” should read -- substantially greater than its thickness “T.” The seamless --
Column 3, line 20 reads “to decrease both it’s width W and thickness T, the slider” should read -- to decrease both its width W and thickness T, the slider --
Column 4, line 47 reads “relaxed” should read -- stretched --
Column 4, line 57 reads “relaxed” should read-- stretched --

Signed and Sealed this

Thirteenth Day of March, 2007

JON W. DUDAS
*Director of the United States Patent and Trademark Office*